United States Patent [19]

Longanbach

[11] 4,397,653

[45] Aug. 9, 1983

[54] METHOD OF PRODUCING A COLLOIDAL FUEL FROM COAL AND A HEAVY PETROLEUM FRACTION

[76] Inventor: James R. Longanbach, Columbus, Ohio, granted to U.S. Department of Energy under the provisions of 42 U.S.C. 2182

[21] Appl. No.: 321,346

[22] Filed: Nov. 13, 1981

[51] Int. Cl.[3] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 2,114,456 | 4/1938 | Pott | 44/51 |
| 2,131,308 | 9/1938 | Blümner | 44/51 |
| 2,453,641 | 11/1948 | Reed | 44/51 |
| 3,764,547 | 10/1973 | Schlinger et al. | 44/51 |
| 4,032,428 | 6/1977 | Johnson | 208/8 |

*Primary Examiner*—Charles F. Warren

*Assistant Examiner*—Y. Harris-Smith

*Attorney, Agent, or Firm*—Hugh W. Glenn; Robert J. Fisher; Richard G. Besha

[57] ABSTRACT

A method is provided for combining coal as a colloidal suspension within a heavy petroleum fraction. The coal is broken to a medium particle size and is formed into a slurry with a heavy petroleum fraction such as a decanted oil having a boiling point of about 300°-550° C. The slurry is heated to a temperature of 400°-500° C. for a limited time of only about 1-5 minutes before cooling to a temperature of less than 300° C. During this limited contact time at elevated temperature the slurry can be contacted with hydrogen gas to promote conversion. The liquid phase containing dispersed coal solids is filtered from the residual solids and recovered for use as a fuel or feed stock for other processes. The residual solids containing some carbonaceous material are further processed to provide hydrogen gas and heat for use as required in this process.

7 Claims, 1 Drawing Figure

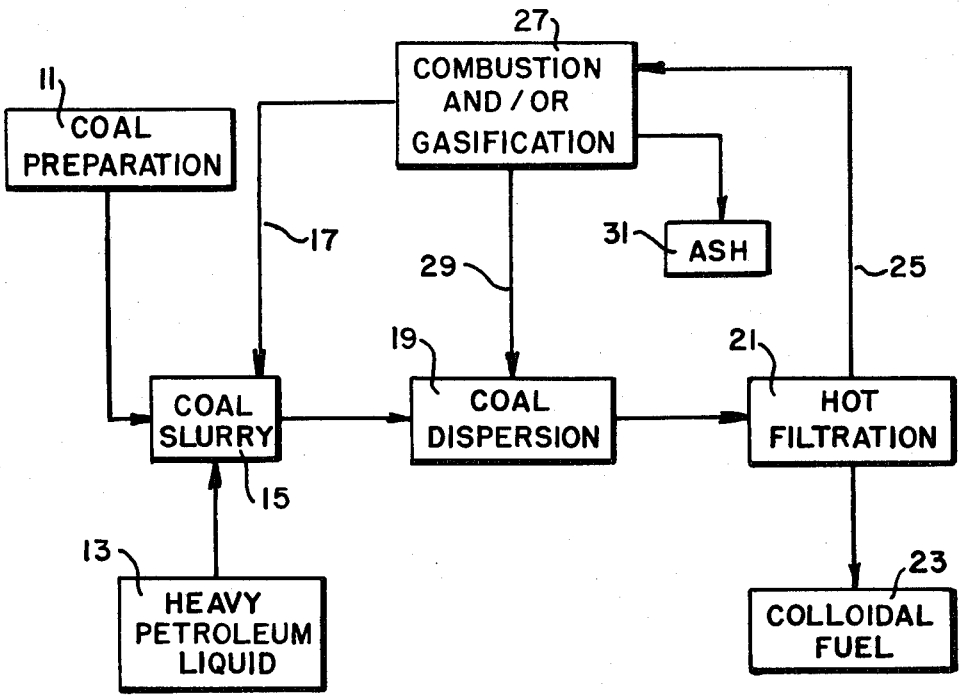
27
COMBUSTION AND / OR GASIFICATION
11
COAL PREPARATION
17
29
31
ASH
25
19
21
COAL SLURRY
COAL DISPERSION
HOT FILTRATION
15
13
HEAVY PETROLEUM LIQUID
23
COLLOIDAL FUEL

METHOD OF PRODUCING A COLLOIDAL FUEL FROM COAL AND A HEAVY PETROLEUM FRACTION

CONTRACTUAL ORIGIN OR THE INVENTION

The United States Government has rights in this invention pursuant to Contract No. DE-ACO1-79ER10062 between the U.S. Department of Energy and Battelle Columbus Laboratories.

BACKGROUND OF THE INVENTION

The invention relates to a process for extending petroleum derived products intended for use as a combustion fuel or as a feed stock for a refinery or coke production operation. It particularly relates to the formation of colloidal suspensions of coal particles within heavy, high boiling point petroleum fractions.

Colloidal fuels have been contemplated for use in steam engines for marine propulsion and for power boilers providing steam for utilities. Such fuels also may have applications in gas turbines or in land powered vehicles.

Coal and oil mixtures as slurries or dispersions have been regarded as a pumpable fuel that can be provided at economically attractive prices when the cost of petroleum is substantially more than that of coal. These mixtures have been prepared by grinding coal and mixing it into oil or other organic solvents to provide a fuel. To provide colloidal mixtures, the coal was ground to extremely small particle size, either separately or in mixture with the solvent. As expected, grinding costs increase with decreased particle size. Expensive wetting or stabilizing agents such as mixtures of alkylstyrene polymers, for instance as described in U.S. Pat. No. 4,130,400, have been proposed to maintain the solids suspended within the liquid. Unfortunately, without continued mixing or the use of such stabilizers, the solid coal particles often settle during storage causing difficulties in the ultimate use of the fuel mixture. Moreover, coal and oil mixtures of this kind often include ash and sulfur that may make additional processing necessary either before or after combustion.

In another area of technology, coal is liquefied by contact with hydrogen at elevated temperatures for an extended period of time to fracture and dissolve the coal into the solvent solution. Most often recycled coal liquid is used as solvent with large hydrogen and heat input rates required to hydrogenate and dissolve the large molecules of condensed aromatic ring structure of the coal. Such processes for solvating or liquefying coal are quite expensive as it is the object of these processes to reduce the coal structure to molecular size that is in liquid state at process operating temperatures. Most often, such processes liquefy substantially all of the carbonaceous material leaving only insoluble constitutents such as fusain, coke and mineral ash which is separated by sedimentation or filtration. This conversion of substantially all the carbonaceous coal material to a molecular liquid state is expensive due to the large input of heat and hydrogen for liquefying the condensed aromatic rings.

Therefore, it is an object of the present invention to provide a method of producing a coal-oil mixture that can be used as a liquid combustible fuel.

It is also an object of the invention to provide a method of preparing a colloidal dispersion of coal particles in a petroleum derived liquid.

It is a further object to provide a method of extending a liquid petroleum fuel through the addition of a solid coal material.

SUMMARY OF THE INVENTION

In accordance with the present invention, a method is presented for producing a liquid fuel or a liquid feed stock including colloidal coal particles dispersed within a petroleum fraction. The coal is comminuted to particles and contacted with a petroleum fraction having an atmospheric boiling point range of 300°-800° C. The resulting slurry is heated to a temperature of 400°-500° C. and maintained there for only 1-5 minutes contact time to disperse a portion of the coal solids into the liquid phase. During the contacting step, the system can be pressurized by the vapor pressure of the liquid or by application of hydrogen gas at an elevated pressure. The liquid phase containing colloidal coal is filtered from the residual solids as the process product and the residual solids are further processed to provide hydrogen gas and heat that can be used as needed in contacting the coal with the petroleum fraction.

In more specific aspects of the invention, the petroleum fraction and hydrogen gas are maintained in contact with the comminuted coal at 400°-500° C. for a period of only about two minutes prior to cooling to less than 300° C. and filtering off the liquid phase.

In one other aspect of the invention, the petroleum fraction is preferably a decanted oil having a boiling point of 300°-550° C.

In a further specific contemplation of the invention, the liquid phase filtered from the residual solids contains 40-80 weight percent moisture ash free (MAF) of the original coal solids suspended as colloidal particles or as liquefied coal material.

In one other specific embodiment of the invention, the residual solids are removed for further processing in gasification and combustion means to provide hydrogen gas and heat for contacting the coal and liquid slurry at 400°-500° C.

BRIEF DESCRIPTION OF THE DRAWING

The present invention is illustrated in the accompanying FIGURE which is a diagrammatic flow of a process for combining coal into a stream of high boiling petroleum product.

DETAILED DESCRIPTION OF THE PREFERRED EMBODIMENT

The drawing illustrates a process for combining solid coal material with a liquid petroleum stream so as to form a colloidal fuel that can be pumped and utilized in combustion facilities adapted for liquid fuels. This liquid product also may have application as a feed stock for further refining or coke production processes. The combination of the coal with the petroleum product thereby extends the amount of liquid petroleum product that would otherwise be available by the addition of the more plentiful coal material.

The coal is prepared at 11 by comminuting the coal, such as bituminous or lignite coal, to a convenient particle size. The actual particle size is not critical since subsequent processing is intended to provide colloidal size solids for dispersion. Typical comminuted particles of about 100 to 2000 microns are contemplated. Although not required, various coal benefaction procedures also may be used such as treatment with alkali metal hydroxide solutions or preoxidation to minimize agglomeration of the coal material.

The comminuted coal is then mixed with a heavy petroleum product from 13 to form a coal slurry at 15. The petroleum derived liquid must be sufficiently heavy to support colloidal size particles that will subsequently be formed during the dispersion and suspension of the coal material. A suitably heavy petroleum derived fraction will have a boiling point range of about 300°-800° C. However a small portion of lower boiling material eg to 100° C. can be included where convenient without seriously affecting the effectiveness of the supporting liquid.

From the standpoint of supporting the suspended colloidal particles, it is preferred that the petroleum liquid have a high aromatic content and a boiling point range of 300°-550° C. Petroleum fractions in this range are often designated as decanted oils. Even higher boiling point material can be used but the availability of fractions boiling above 550° C. may be limited. Through use of petroleum products in this high boiling point range for providing a colloidal extended liquid fuel, petroleum fractions of 300° C. and lower remain available for gasoline and diesel fuel products for internal combustion and turbine engines.

A stream of hydrogen gas 17 can be combined with the coal slurry at 15 to enhance conversion of the coal to liquid phase. The hydrogen is provided at a pressure of no more than about 200 atmospheres, typically about 50-150 atmospheres. Although this hydrogen gas presence may be of advantage, it is not essential to the process of this invention and may be omitted to reduce processing costs.

The slurry, with hydrogen gas if used, is then passed through a suitable reactor 19 having means for heat input to cause the chemical comminution and dispersion of the coal particles. Temperatures of 400°-500° C. are required for this purpose but the residence time of contact at these elevated temperatures must be limited to no more than about 1 to 5 minutes. Contact times beyond this critical range will result in coking of both the coal and of the heavy petroleum fraction to increase the solids content of the mixture, e.g., by forming carbon black. Moreover, contact with the hydrogen gas, when used, at these elevated temperatures and pressures for periods of 15 minutes to one hour will begin to liquefy substantial quantities or all of the carbonaceous material within the coal by the hydrogenation of its condensed aromatic ring structure with the accompanying expense of hydrogen and heat consumption.

The inventor has found that these longer contact times are not necessary and are undesirable. A period of about 1 to 5 minutes, preferably about 2 minutes, contact time at the elevated temperature of 400°-500° C. is sufficient with limited or no hydrogen consumption to provide substantial quantities of the coal solids into suspension within a heavy petroleum liquid. The time of contact at these elevated temperatures is limited by rapidly cooling the mixture to less than about 300° C., typically to about 200° C. This can be conveniently accomplished, at least in part, by preheating the feed slurry from 15 in countercurrent flow and by flashing the hot liquid to a more moderate pressure for the subsequent filtration step. Additional cooling can be used as required.

Mineral matter, ash, fusain and carbon black may not remain suspended in the liquid and can be filtered at a temperature of about 200°-300° C. and a pressure of about 1 to 3 atmospheres at 21. Excess hydrogen gas (not shown) is collected or recycled for further use. A liquid phase containing colloidal carbonaceous particles suspended throughout the heavy petroleum liquid can be collected at 23 as a liquid product suitable for use in a variety of applications. The solid matter 25 removed from the filtration step can contain about 20-60% by weight of the original carbonaceous combustible material in the coal. This solid material is sent to a combustion and gasification unit 27 for providing heat 29 for the chemical comminution and dispersion of the coal and for providing the flow of hydrogen gas 17 for mixing with the petroleum and coal slurry at 15.

The combustion and gasification of coal can be carried out in conventional combustors or coal gasification units which are well known in the art. For example, the Lurgi, Koppers-Totzek or the Hygas coal gasifiers might be selected for this purpose. These coal gasifier systems are disclosed in many references including *Scientific American,* March 1974, pages 22-23. The gas thus produced can be subjected to the water gas shift reaction to enrich it in hydrogen for contacting the coal slurry. In processes where hydrogen gas is not required for dispersing the coal solids into the liquid, hydrogen and or sythesis gas can be recovered as additional process product.

The following Examples are submitted as an illustration of the invention which is defined only in the claims.

EXAMPLE I

Westland bituminous coal, 200 g ground to −50 mesh (297 microns), was slurried in 600 g of "decanted oil", a refinery stream containing approximately 90 percent aromatics with about 310° to 540° C. boiling point range, and preheated to 250° C. with stirring in a 2-liter autoclave. The slurry was then transferred to a second preheated autoclave where it was rapidly heated to about 430° C. and held at temperature for only 5.0 minutes under about 14 atmospheres total pressure. No hydrogen was added to the system. The products were transferred back to the preheater autoclave and cooled quickly to about 200° C. with an internal cooling coil. A solubility test in tetrahydrofuran (THF) prior to filtration indicated that about 73 weight percent of the MAF coal was converted to product.

Under identical conditions, Colstrip subbituminous coal gave a 45 weight percent MAF conversion to THF solubles.

EXAMPLE II

Kentucky 9 bituminous coal, 200 g, ground to −100 mesh (149 microns), was slurried in 600 g of whole Alaskan North Slope crude oil. The crude oil has a boiling point range of 100° to 550+° C. The slurry was preheated with stirring to 250° C. and transferred to a second preheated autoclave where the temperature was rapidly increased to about 430° C. and held for 2 minutes under 96 atmospheres of hydrogen. The products were then transferred to a third autoclave where they were quickly cooled to 200° C. The conversion to pyridine solubles was 56 percent of the MAF coal.

It is therefore seen that the present invention provides a process by which a heavy petroleum fraction can be extended by the addition of dispersed coal solids. The process does not require a large energy input for comminuting the coal mechanically to fine particle size nor does it require the use of expensive colloidal stabilizers or wetting agents to retain the colloidal size particles suspended in the liquid. The process is of advantage over known coal liquefaction processes in that substantially less contact time at elevated temperatures and with hydrogen gas is required. In addition, the reduced residence time of the coal and liquid in the process allows reduced volume of process units per given production rate.

Although the present invention is described in terms of specific materials and process conditions, it will be clear to one skilled in the art that various changes can be made within the scope of the invention defined in the accompanying claims.

The embodiment of this invention in which an exclusive property or privilege is claimed are defined as follows:

1. A method of producing a liquid fuel or feed stock containing colloidal coal particles suspended in a petroleum fraction comprising:

comminuting coal to particles;

contacting said comminuted coal with a petroleum fraction having an atmospheric boiling point range of 300°–800° C. to form a slurry;

heating said slurry to a temperature of 400°–500° C. at a pressure of about 10–200 atmospheres and maintaining said slurry at this temperature for no more than 1 to 5 minutes;

cooling said slurry to a temperature of less than 300° C. after only 1 to 5 minutes contact time at 400°–500° C.;

filtering the liquid phase from the residual solids of said slurry;

processing said residual solids to provide hydrogen gas and heat;

recovering said liquid phase with suspended coal particles for use.

2. The method of claim 1 wherein said comminuted coal is contacted with said petroleum fraction and with hydrogen gas at a temperature of 400°–500° C. for a period of no more than about 1 to 5 minutes prior to filtering the liquid phase from the residual solids.

3. The method of claim 1 wherein said petroleum fraction is a decanted oil having a boiling point of about 300° to 550° C.

4. The method of claim 1 wherein said liquid phase filtered from said residual solids contains 40–80 weight percent MAF of the comminuted coal solids suspended as colloidal particles or as liquefied coal material.

5. The method of claim 1 wherein said residual solids are gasified and combusted to provide hydrogen gas and heat for said contacting step.

6. The method of claim 1 wherein said contact time at said 400°–500° C. in the presence of hydrogen gas is limited to only about 2 minutes prior to cooling to less than 300° C.

7. The method of claim 1 wherein said slurry is cooled to a temperature of 200°–300° C. prior to said filtration step.

* * * * *